US009021849B2

(12) United States Patent
Rusch

(10) Patent No.: US 9,021,849 B2
(45) Date of Patent: May 5, 2015

(54) SHRINKER STRETCHER MACHINE

(76) Inventor: Christopher J. Rusch, Two Rivers, WI (US)

( * ) Notice: Subject to any disclaimer, the term of this patent is extended or adjusted under 35 U.S.C. 154(b) by 818 days.

(21) Appl. No.: 13/200,627

(22) Filed: Sep. 26, 2011

(65) Prior Publication Data

US 2013/0074569 A1 Mar. 28, 2013

(51) Int. Cl.
*B21D 25/04* (2006.01)
*B21D 11/18* (2006.01)

(52) U.S. Cl.
CPC ..... *B21D 25/04* (2013.01); *B21D 11/18* (2013.01)

(58) Field of Classification Search
CPC ..... B21D 1/00; B21D 25/04; B21D 53/92; B21D 31/04; B21D 26/00; B21D 26/021; B21J 7/04
USPC ..... 72/300–302, 304, 308, 377, 412, 416, 72/470, 475; 269/86, 104, 134, 164
See application file for complete search history.

(56) References Cited

U.S. PATENT DOCUMENTS 2,357,204 A * 8/1944 Joyner ..... 72/395
7,331,207 B2 * 2/2008 Borgwarth ..... 72/448
7,810,368 B2 * 10/2010 Rusch ..... 72/450

OTHER PUBLICATIONS http://www.youtube.com/watch?v=DygYXDxCj7l uploaded by Baileigh Industrial on Aug. 20, 2010.*
http://www.trick-tools.com/common/documentation/mss-14h.pdf Trick-Tools.com Rusch Machine & Design, Inc.*
Website printout for TCE-ERCO Model 1447sheet metal shrinking and stretching machine sold since prior to 2011.
Website printout for Fay Butler ERCO Kick Shrinker sold since prior to 2011.

* cited by examiner

*Primary Examiner* — Peter DungBa Vo
*Assistant Examiner* — Joshua D Anderson
(74) *Attorney, Agent, or Firm* — Jeffrey S. Sokol; Sokol Law Office

(57) ABSTRACT

The present invention is a shrinker stretcher machine that uses four distinct and separate tool cartridges to perform both shrinking and stretching operations by simply removing, rotating each tool cartridge 180 degrees, and reattaching it in its designated position. Each tool cartridge removably carries a jaw that can be removed and securely replaced with either a shrinker or stretcher jaw to accommodate the operation being performed. Each tool cartridges and jaw is firmly held in place by magnets and interlocking keyed surfaces to properly align and hold the tool cartridges and jaws.

20 Claims, 16 Drawing Sheets

SHRINKER STRETCHER MACHINE

TECHNICAL FIELD OF THE INVENTION

This invention relates to a power shrinker stretcher machine for shaping sheet metal that includes tool cartridges that allow easy conversion from shrinking to stretching.

BACKGROUND OF THE INVENTION

Sheet metal shrinking and stretching machines are well known. These machines include a first set of four tool cartridges that are specifically for shrinking sheet metal, and a second set of four tool cartridges that are specifically for stretching sheet metal. Each cartridge has a jaw for compressible engaging and gripping a sheet metal workpiece. When the upper and lower jaws are separated, the sheet metal is placed between the gap between them. The operation of the machine brings the jaws into compressed engagement with the sheet metal, which is located between the upper and lower jaws. The jaws firmly hold the sheet metal in place between the upper and lower jaws. During shrinking mode, further compression of the jaws causes the right and left jaw sets to move toward each other so that a thin strip of the sheet metal between the right and left jaw sets is compressed or shrunk. During the stretching mode, further compression of the jaws causes the right and left jaw sets to move apart so that a thin strip of the sheet metal between the right and left jaw sets is stretched.

A problem with conventional shrinker stretcher machines is that switching from the shrinking mode to the stretching mode requires two tool units, each containing four tools, for a total of eight tools. One shrinker unit must be removed and replaced with a stretcher unit. The operator must have both tool units on hand in order to make the switch.

Another problem with conventional shrinker stretcher machines is that a shrinker unit includes four integral tools. If one tool in the shrinker unit breaks or becomes jammed, then the entire unit (all four tools) are rendered unusable. Similarly, if one tool in the stretcher unit breaks or becomes jammed, then the entire unit (all four tools) are rendered unusable. As a result, the efficient operation of a conventional shrinker stretcher machine typically requires one extra shrinker unit and one extra stretcher unit to be on hand to prevent costly machine down time. Yet, each shrinker unit and each stretcher unit is relatively expensive.

A still further problem with conventional shrinker stretcher machines is that each shrinker unit includes four integral jaws. Yet, different sheet metal thicknesses or materials such as aluminum, copper, copper-nickel, mild steel, steel, stainless steel work best with different types of jaw surfaces textures to grip the sheet metal during operation. Different jaw surface textures produce the different gripping power needed to shrink or stretch different materials or material thicknesses. In addition, some job specifications require minimal surface distortion to achieve a necessary level of smoothness in the finished workpiece. While a knurled or low grit jaw surface may work best for a particular material, material thickness or project specification, a serrated jaw surface may work best for another, and a large grit or hard grit or even diamond grit surface may work best for yet another. Yet, because the jaws are integral components of the shrinker or stretcher tool units for conventional shrinker stretcher machines, multiple shrinker tool units or stretcher tool units are required to effectively handle a wide variety of sheet metals materials, sheet metal thicknesses or project specifications.

A still further problem with conventional shrinker stretcher machines is their limited range of use. While the machines produce enough gripping power to adequate handle softer sheet metal materials, such as aluminum, copper, copper-nickel or mild steel, they do not produce enough gripping power to adequately handle harder materials, such as steel or stainless steel. The gripping power of many conventional machines also limits the thickness of the sheet metal workpieces they can handle, as thicker sheets require more gripping power to shrink or stretch the metal.

The present invention is intended to solve these and other problems.

BRIEF DESCRIPTION OF THE INVENTION

The present invention pertains to a shrinker stretcher machine that uses four distinct and separate tool cartridges to perform both shrinking and stretching operations by simply removing, rotating each tool cartridge 180 degrees, and reattaching it in its designated position. Each tool cartridge removably carries a jaw that can be removed and securely replaced with either a shrinker or stretcher jaw to accommodate the operation being performed. Each tool cartridges and jaw is firmly held in place by magnets and interlocking keyed surfaces to properly align and hold the tool cartridges and jaws.

One advantage of the present shrinker stretcher machine is that switching from shrinking mode to stretching mode only requires one set of four tool cartridges. The tool cartridges are removed, rotated 180 degrees, and resecured to the machine to convert from shrinking mode to stretching mode. Accordingly, the operation of the machine does not require a first set of four tool cartridges that are specifically for shrinking sheet metal, and a second set of four tool cartridges that are specifically for stretching sheet metal.

Another advantage of the present shrinker stretcher machine is that it uses four separate tool cartridges. If one tool cartridge breaks or becomes jammed, only that cartridge need be replaced. The machine can continue using the other three tool cartridges. The efficient operation of the present shrinker stretcher machine requires only one or two extra cartridges to avoid costly machine down time.

A still further advantage of the present shrinker stretcher machine is that each tool cartridge can accommodate multiple jaws with multiple surface textures. For the low cost of obtaining multiple jaws and surface textures, the machine can properly handle different sheet metal thicknesses or different materials such as aluminum, copper, copper-nickel, mild steel, steel and stainless steel. The jaw surface texture that produces the proper gripping power can be cost effectively selected to shrink or stretch different materials or material thicknesses. In addition, the appropriate jaw surface texture can be cost effectively chosen for job specifications that require minimal surface distortion to achieve a necessary level of smoothness in the finished workpiece. While a knurled or low grit jaw surface can be used for a particular material, material thickness or project specification, a serrated jaw surface can be swapped for another type of job, and a large grit or hard grit or even diamond grit surface can be used for yet another job. Costs are kept to a minimum because only different jaws need be obtained, not entire conventional shrinker tool units or entire conventional stretcher tool units.

A still further advantage of the present shrinker stretcher machines is its power and durable design. The hydraulic power unit is capable of producing 2,000 psi of hydraulic pressure, which produces about 10,000 lbf at the piston rod of the hydraulic cylinder and about 40,000 lbf at the drive rod or the driven ram. Accordingly, the machine is capable of handling a wide variety of sheet metal materials and material thicknesses. The machine can handle softer materials, such as aluminum, copper, copper-nickel and mild steel, and harder materials, such as steel and stainless steel. The machine also produces sufficient gripping power to handle thicker sheet metals workpieces of up to about ⅛ inch thick aluminum or 14 gauge steel, but can be scaled up to handle ¼ thick steel.

A still further advantage of the present shrinker stretcher machine is its adjustability during operation to control the incremental amount of shrinking or stretching during each compression stroke and sheet metal movement cycle of the machine. A stroke length adjustment mechanism is provided to allow some adjustment in the tool stroke length of the machine. A gap adjusting wheel also allows the operator to control the gap between the jaws and the tool during operation. These adjusting mechanisms allow the operator to control the incremental amount of shrinking or stretching during each compression stroke of the machine.

A still further advantage of the present shrinker stretcher machine is its adjustability to accommodate different sheet metal materials and thicknesses. The jaws can slip when handling harder materials or thicker sheet metal workpieces because more gripping force between the jaws is needed to firmly grip the workpiece before shrinking or stretching occurs. The tools of the present shrinker stretcher machine are adjustable to achieve higher or lower gripping force between the jaws and the sheet metal before the shrinking or stretching occurs.

Other aspects and advantages of the invention will become apparent upon making reference to the specification, claims and drawings.

DESCRIPTION OF THE PREFERRED EMBODIMENTS

Figure 1:
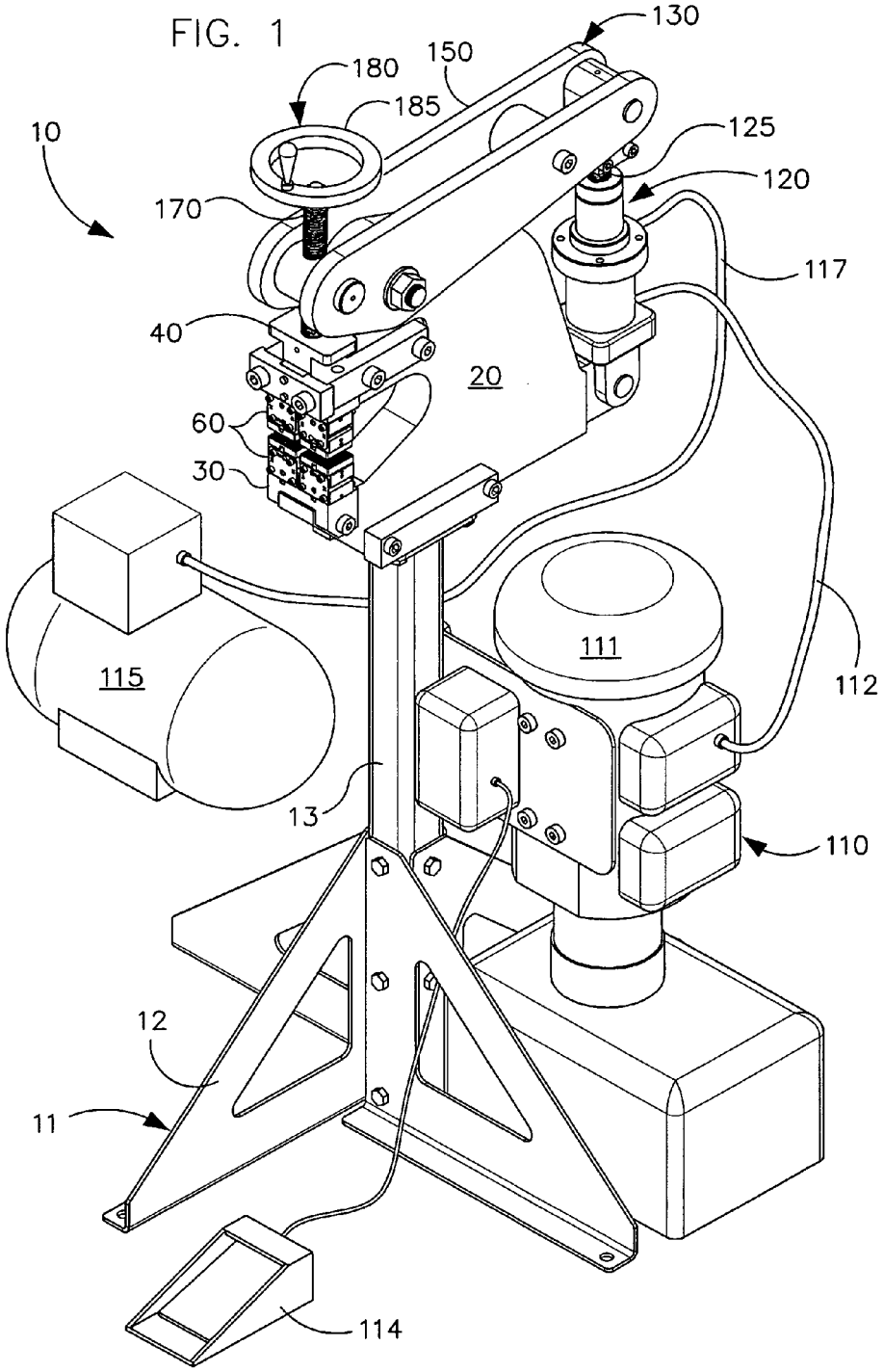
FIG. 1 is a perspective view of the inventive shrinker stretcher machine 10 showing its support frame 11, upper support structure 20, fixed anvil 30, moving ram 40, tools 60, power supply and control system 110 and tool drive assembly 130.
Figure 2:
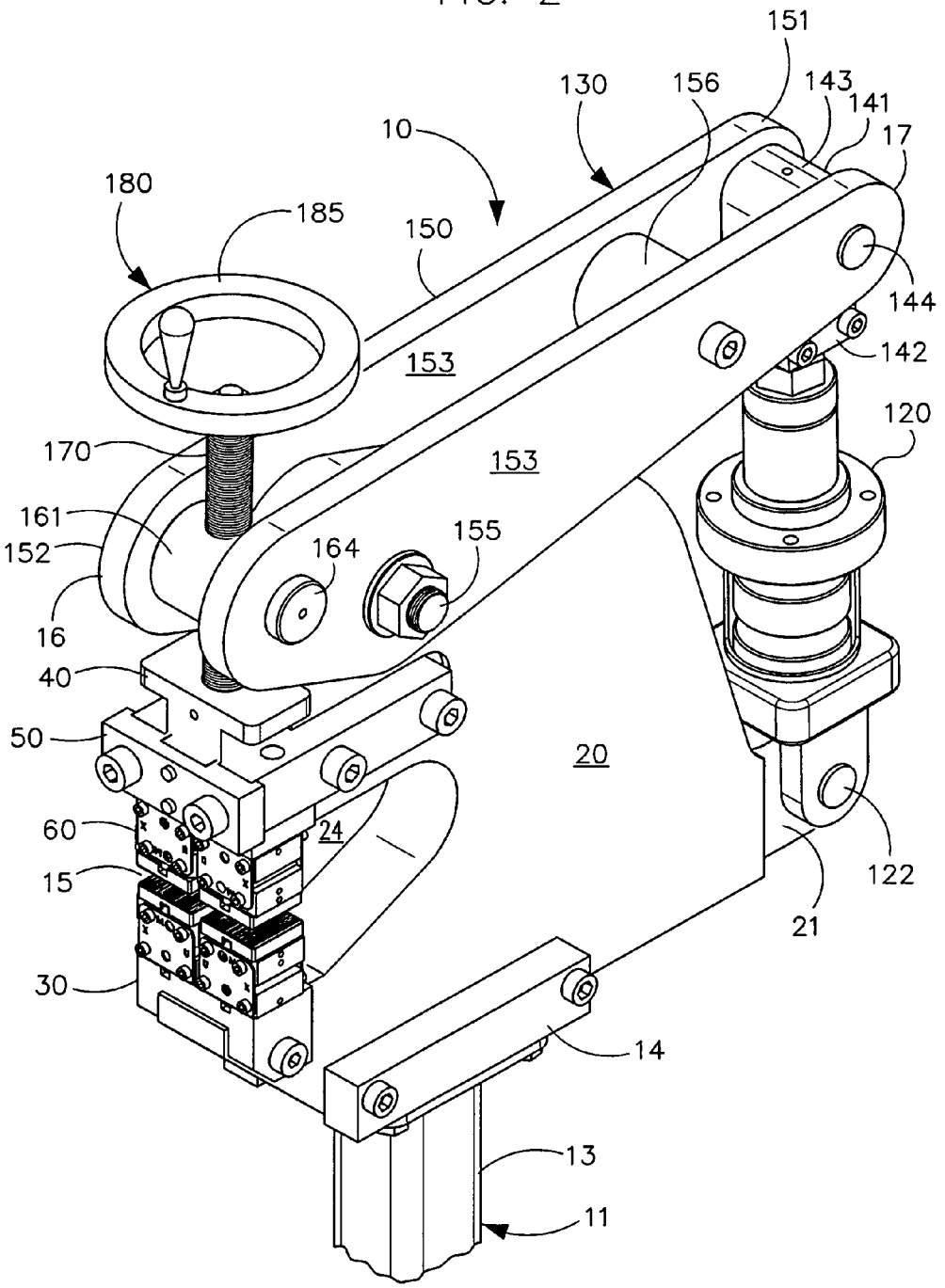
FIG. 2 is an enlarged view of the shrinker stretcher machine 10 showing its support structure 20, fixed anvil 30 and ram 40, tools 60 and tool drive assembly 130.
Figure 3:
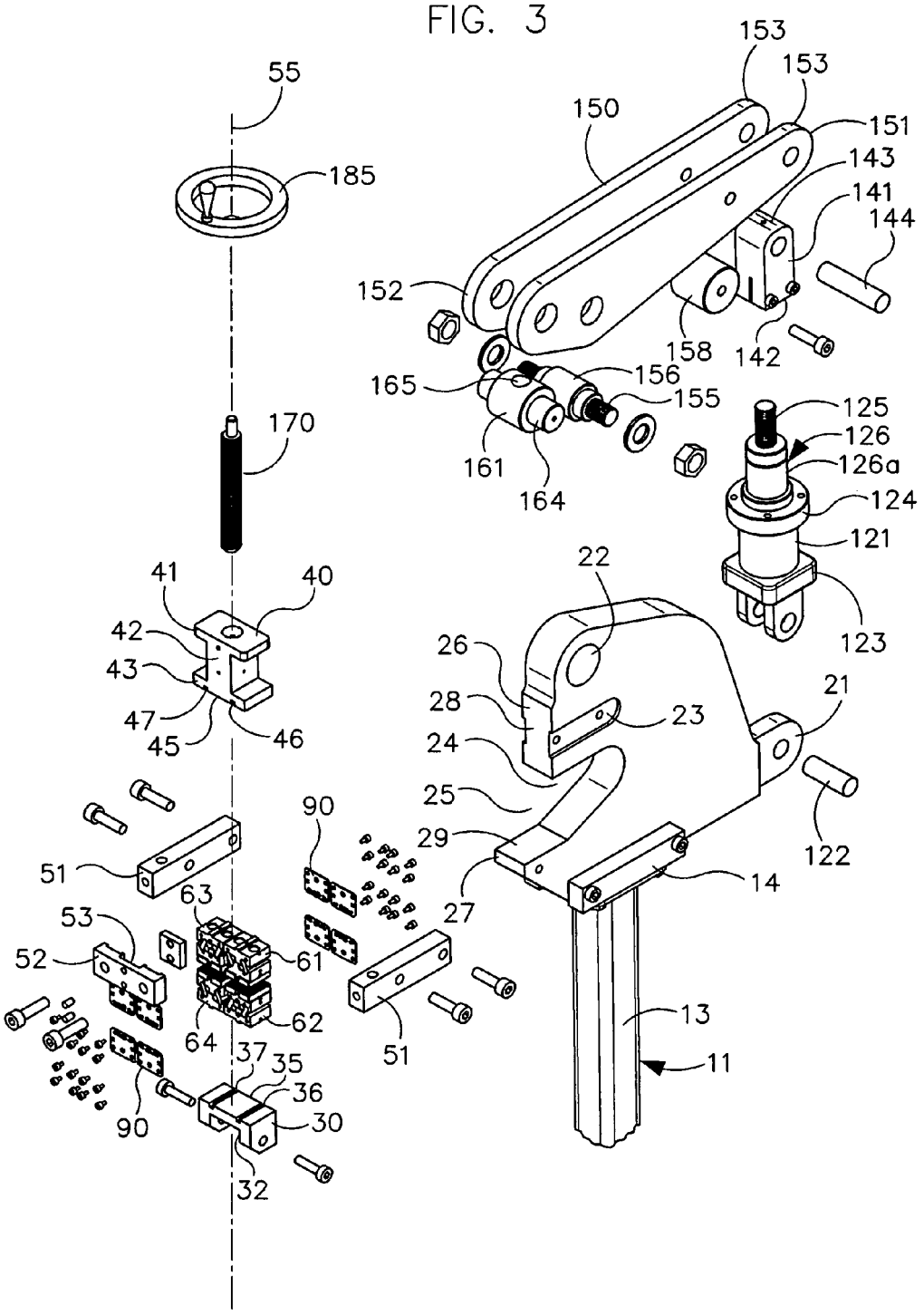
FIG. 3 is an exploded view of the shrinker stretcher machine 10 showing its fixed anvil 30, ram 40, tools 60 and tool drive assembly 130.

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

The present invention relates to a power shrinker stretcher machine for shaping a workpiece 5 such as a sheet of metal. The shrinker stretcher machine is generally depicted as reference number 10 in FIG. 1. The shrinker stretcher machine 10 is mounted on a support frame 11 that includes a base 12 that rests on the floor of a building. The base 12 has a wide footprint to stabilize during operation. The frame 11 has a central post 13 extending upwardly from the base 12 to elevate a workpiece receiving area 15 of the machine 10 about three feet above the floor to facilitate ease of use and material handling during operation. The machine 10 is secured to the top of the post 13 via brackets 14, and is about four and a half feet tall and has a front 16 to back 17 depth of about one and a half feet. While the machine 10 is particularly suited for shaping sheet metal 5, it should be understood that the broad aspects of the invention are not limited to sheet metal.

The shrinker stretcher machine 10 includes a support structure or plate 20 for attaching many of the various other components forming the machine. The plate 20 is robustly designed and about two inches thick to withstand the significant cyclical loads produced by the machine 10. The support plate 20 has parallel and planar side surfaces, and is oriented perpendicular to the ground. The support plate 20 has a generally round C-shaped configuration and perimeter. The C-plate 20 forms a rear hinge 21 with a hinge hole, an upper pivot hole 22, forward anvil guide slots 23 and a large central opening 24 extending inwardly from a front mouth 25 of the machine. The C-shaped plate 20 defines the upper and lower jaws 26 and 27 located above and below its mouth 26 for receiving the workpiece 5. The mouth 26 generally forms the working area 15 of the machine 10. The upper jaw 26 has a flat vertical front surface 28 proximal the guide slots 23 and is slightly recessed from the lower jaw 27. The lower jaw 27 has a flat horizontal upper surface 29.

A fixed anvil or plate 30 is secured to the lower jaw 27 of the C-plate 20. The fixed anvil 30 has a U-shaped configuration with a lower flat bottom slot surface 32 that flushly engages the flat upper surface 29 of the plate 20. The fixed anvil 30 is slightly wider than the C-plate 20 so that its sides snuggly overlap the plate 20 to prevent side-to-side movement. The sides of the anvil 30 are also rigidly secured to the C-plate 20 via bolts or the like. The upper surface 35 of the anvil 30 is generally horizontal and flat, except for right 36 and left 37 tool slots. The tool slots 36 and 37 are parallel to each other, and in generally linear alignment with C-plate 20. The slots 36 and 37 are spaced apart a predetermined distance of about 1.82 inches, each being spaced equidistantly from the center of the plate 20, anvil 30 and machine centerline 55 as discussed below.

A driven anvil 40 is positioned directly above and in registry with the fixed anvil 30. The driven anvil 40 has an 1-beam shape configuration with an upper flange 41, a central web 42 and a lower flange 43. The lower flange 43 has a lower surface 45 that is about the same size as the upper surface 35 of the fixed anvil 30. The lower surface 45 of the lower flange 43 is generally horizontal and flat, except for right 46 and left 47 tool slots. The tool slots 46 and 47 are parallel to each other, and in generally linear alignment with C-plate 20. The slots 46 and 47 are spaced apart a predetermined distance of about 1.82 inches, each being spaced equidistantly from the center of the plate 20, lower flange 43 and machine centerline 55. As a result, the slots 46 and 47 of the driven anvil 40 are directly above and in parallel registry with the slots 36 and 37 of the fixed anvil 30.

A guide 50 movingly holds the driven anvil 40 to the upper jaw of the C-plate 20. The guide includes two spaced side brackets 51 joined by a front bracket 52. The side brackets 51 are flushly and snuggly received by the slots 23 of the C-plate 20 so that they extend horizontal at a predetermined location relative to the mouth 25 and upper and lower jaws 26 and 27 of the C-plate 20. The front bracket 52 forms a flat vertical inwardly facing slot 53. The drive anvil 40 is received between the guide 50 and upper jaw 26 of C-plate 20. The anvil web 42 has flat front and rear surfaces that flushly and slidably engage the flat front surface 28 of the upper jaw 26 and front slot 53 of the guide 50. The sides of the anvil web 42 flushly and slidably engage the side brackets 51 of the guide 50. The length of the web 42 is longer than the side brackets 51 so that the outer ends of the flanges 41 and 43 extend over and outwardly from the side brackets 51 to form limit stops for the driven anvil 40. The upper flange 41 forms the lower limit stop of movement for the drive anvil 40 to prevent inadvertent damage to the tools during the operation of the machine 10 as described below.

Figure 5A:
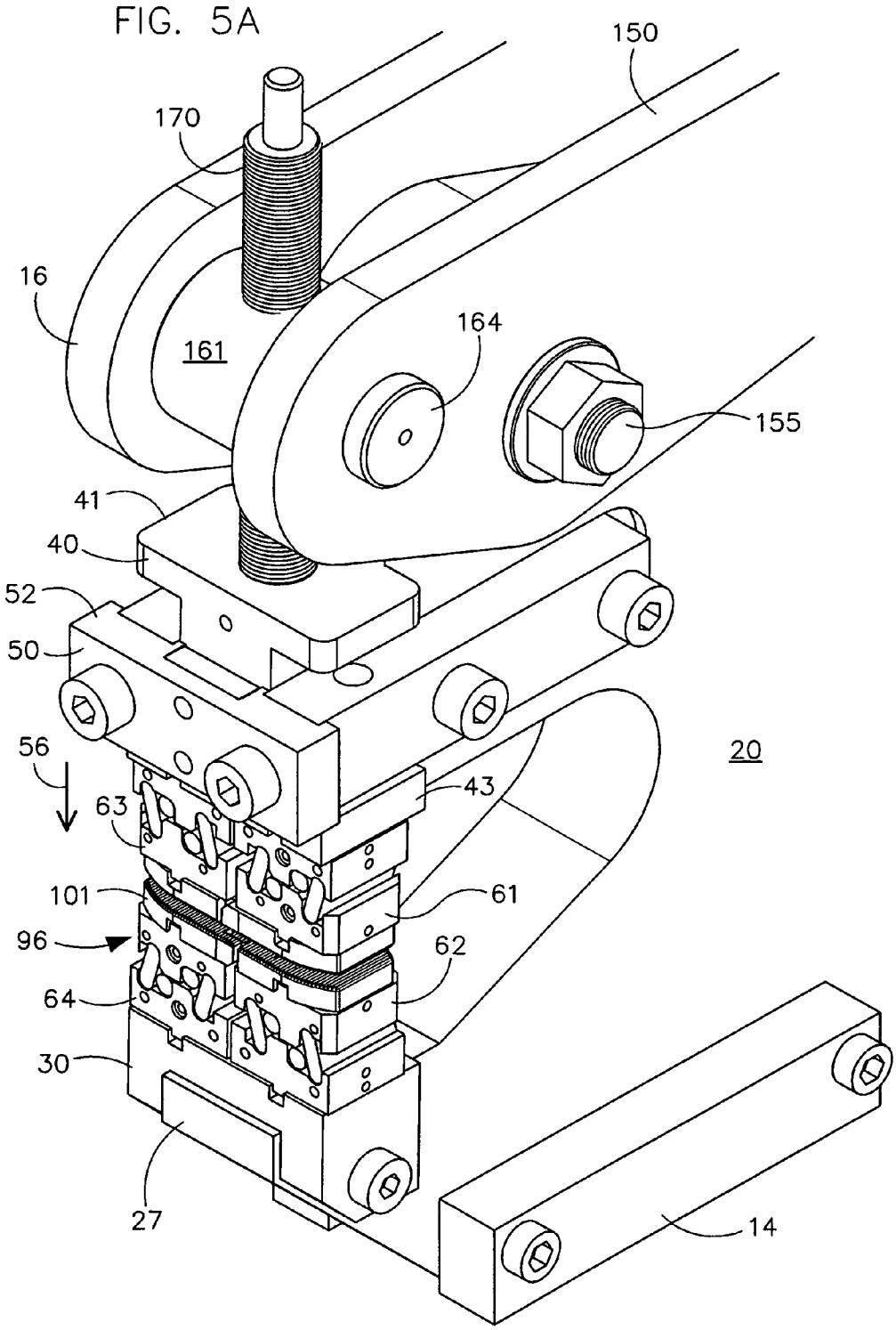
FIG. 5A is an enlarged view the four tools 61-64 with shrinker jaws 101 and arranged in shrinking alignment.
Figure 5B:
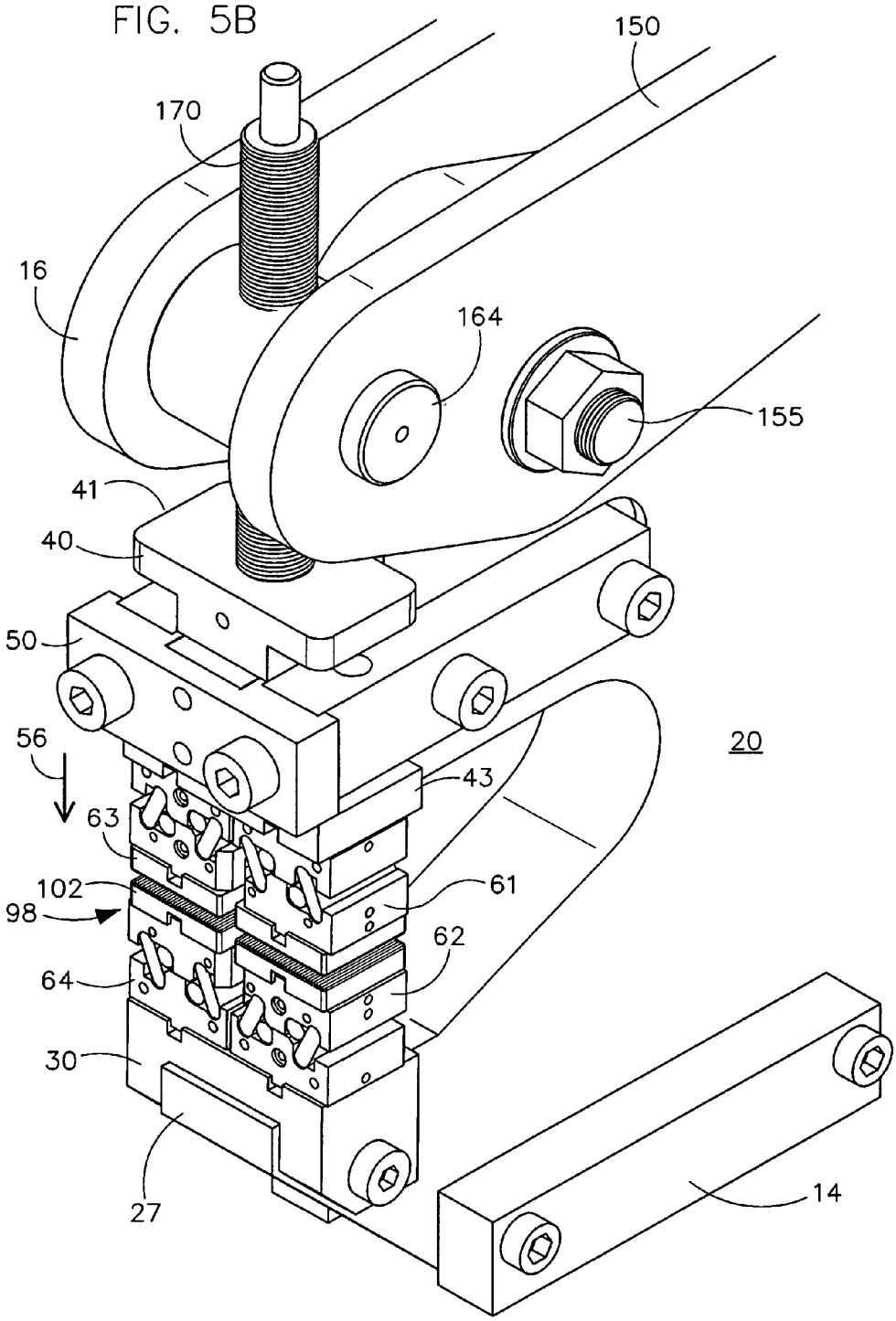
FIG. 5B is an enlarged view the four tools 61-64 with stretcher jaws 102 and arranged in stretching alignment.

The parallel side surfaces of the support plate 20 and guide 50 define a centerline 55 of ram 40 movement for the machine 10. The anvil 30 and ram 40 are symmetrical about centerline 55. The driven anvil 40 is free to slide up and down in the guide 50 along a vertical path of travel 56 in linear alignment with the machine centerline 55 as shown in FIGS. 5A and 5B. As discussed below, during each cycle of operation, the ram or driven anvil 40 travels between a raised or retracted position 57 shown in FIGS. 6A, 7A and 8A, a partially extended workpiece gripping position 58 shown in FIGS. 6B, 7B and 8B, and a fully extended workpiece formed position 59 shown in FIGS. 6C, 7C and 8C.

The machine 10 is fitted with four tools 60. Two tools 62 and 64 are secured to the fixed anvil 30. Two tools 61 and 63 are secured to the moving anvil or ram 40. The first and second tools 61 and 62 on the right side of the machine centerline 55 form a first workpiece gripping set 65, and the third and fourth tools 63 and 64 on the left side form a second workpiece gripping set 66. Each cartridge 70 has a width of about 1-⅝ inches, depth of about 1-⅜ inches and height of about 1-⅞ inches including jaws 100. The cartridge 70 has substantially flat, opposed outer end surfaces 67 and 68 with substantially the same footprint. Both surfaces 67 and 68 are in spaced substantially horizontal alignment. The spacing between the surfaces 67 and 68 changes when outer rotating surface 68 moves sideways in a rotational manner relative to fixed surface 67 during the operation of the machine 10 as discussed below. Still, these surfaces 67 and 68 remain in substantially parallel alignment throughout the operation of the machine 10.

Each tool 60 includes a cartridge 70 having a matched set of fixed 71 and moving 75 block halves. Each set of block halves 71 and 75 is aligned in mating registry. Each block half 71 and 75 has about the same width, depth and height. Each fixed block half 71 has a predominantly flat outer surface 72 (cartridge surface 67) with a linear outwardly extending rib 73 extending from the front to the rear of the block. The ribs 73 and 77 are located at the center of their respective block half 71 and 75. Each moving block half 75 has an opposed predominantly flat outer surface 76 (cartridge surface 68) with a linear outwardly extending rib 77 extending from the front to the rear of the block. The linear rib 77 is parallel to rib 73 but offset from the centerline of the moving block half 75 about 0.050 inch (when in home position 87). The inner surface of each block 71 and 75 forms a pocket 74 or 78 with a constant radius groove and an adjacent slot. One pocket 74 and 78 is located on each side of the ribs 73 and 77. Each block 71 and 75 also holds two disc shaped magnets 79 in holes 79*a* formed in its outer surface 72 and 76. The outer surface of each magnet 79 is flush with the outer surface 72 or 76 of its block 71 or 76. Each magnet 79 is rigidly held in its respective block 71 or 75 by a set screw. One magnet 79 is located on each side of the ribs 72 and 77. While magnets 79 are shown holding the tool cartridges 70 to the fixed anvil 30 and ram 40 for ease of securement and removal, it should be understood that the tools could be secured with screws or other forms of securement without departing from the broad aspects of the invention.

Each cartridge 70 holds two rigid metal cams 80 aligned in parallel relation. The cams are like-shaped and spaced apart to form a parallelogram. One cam 80 is located on each side of the ribs 73 and 77 of its cartridge 70. Each cam 80 has opposed stationary 81 and rotating 82 ends. The stationary end 81 of each cam 80 has a constant radius that flushly and pivotally engages the constant radius groove of the interior pocket 74 of its fixed block half 71. Likewise, the rotating end 82 of each cam 80 has a constant radius that flushly and pivotally engages the constant radius groove of the interior pocket 74 of its moving block half 75. Each cam 80 has a length of about 1⅜ inches, a height of about ⅞ inch, a width of about ¼ inch, and maintains its shaped during the operation of machine 10. Each elongated cam 80 extends from the front to the rear of the cartridge 70.

Each cam 80 has an adjacent resilient spring sleeve 85 aligned parallel to and engaging the cam through its full length. The resilient sleeve springs 85 are relatively hard to compress, and are preferably made of polyurethane with a hardness of about a 90 durometers. Each sleeve spring 85 has a uniform cylindrical shape with a diameter of about ⅜ inch, and a length that extends about the width of the cartridge 70. One spring sleeve 85 is held in the pocket 74 of the fixed block 71, and one spring sleeve is held in the pocket 78 of the moving block 75. One cam 80 and spring sleeve 85 set is located on each side of the central ribs 73 and 77 of the cartridge 70.

Figure 6A:
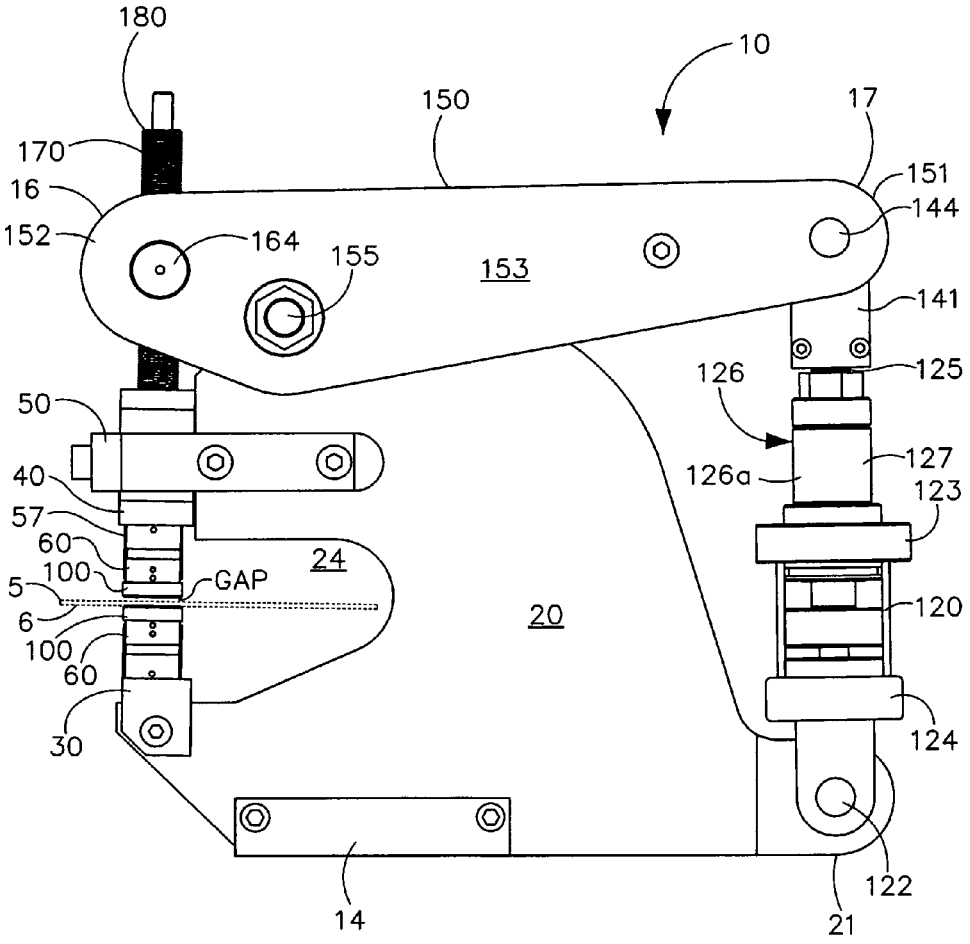
FIG. 6A is a side plan view showing a sheet metal workpiece 5 located in the Gap between tools 60 when ram 40 and piston rod 120 are in release positions 57 and 127.
Figure 7A:
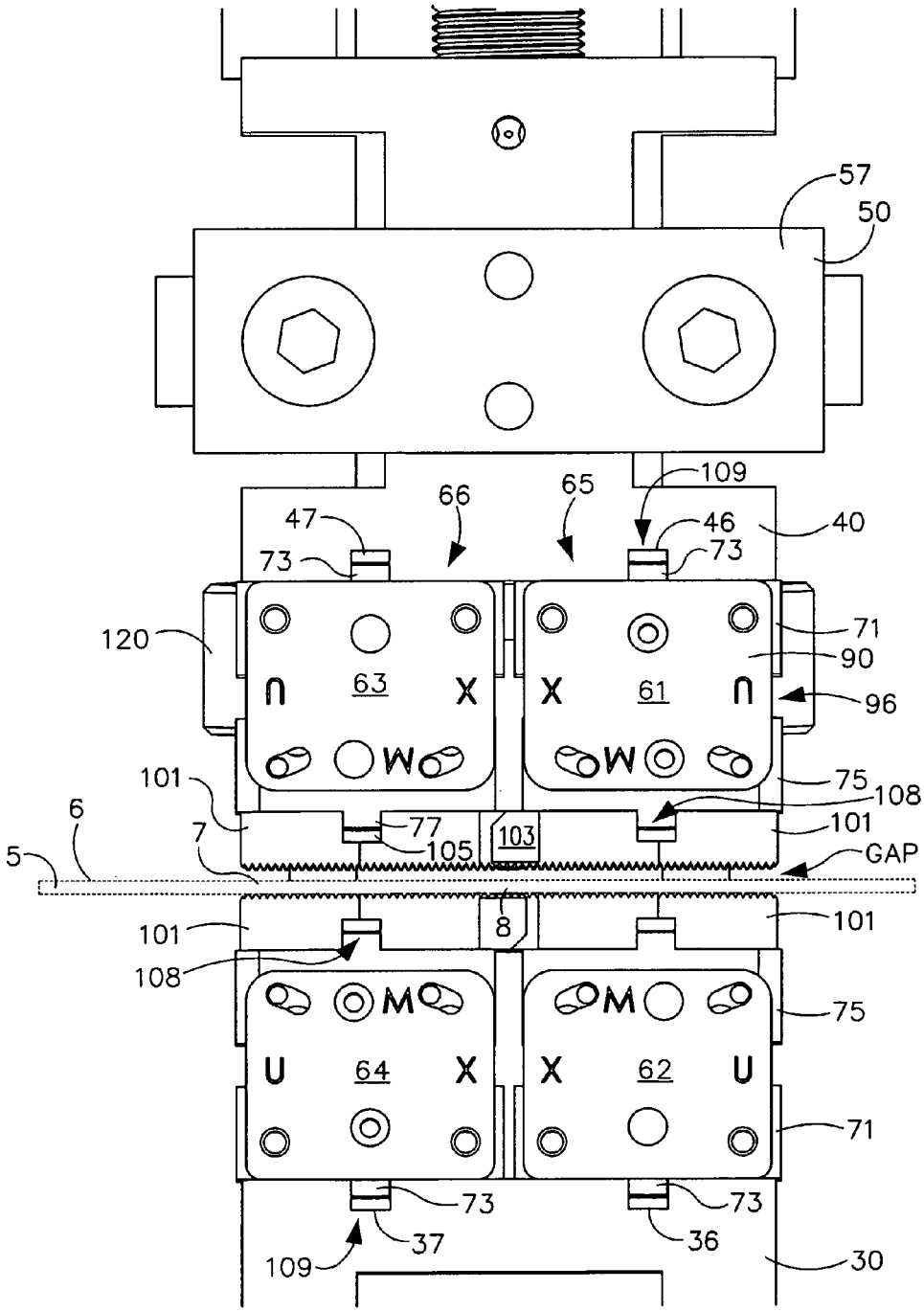
FIG. 7A is an enlarged front view showing a sheet metal workpiece 5 located in the Gap between tools 60 equipped with shrinker jaws 101 when ram 40 and piston rod 120 are in release positions 57 and 127.
Figure 8A:
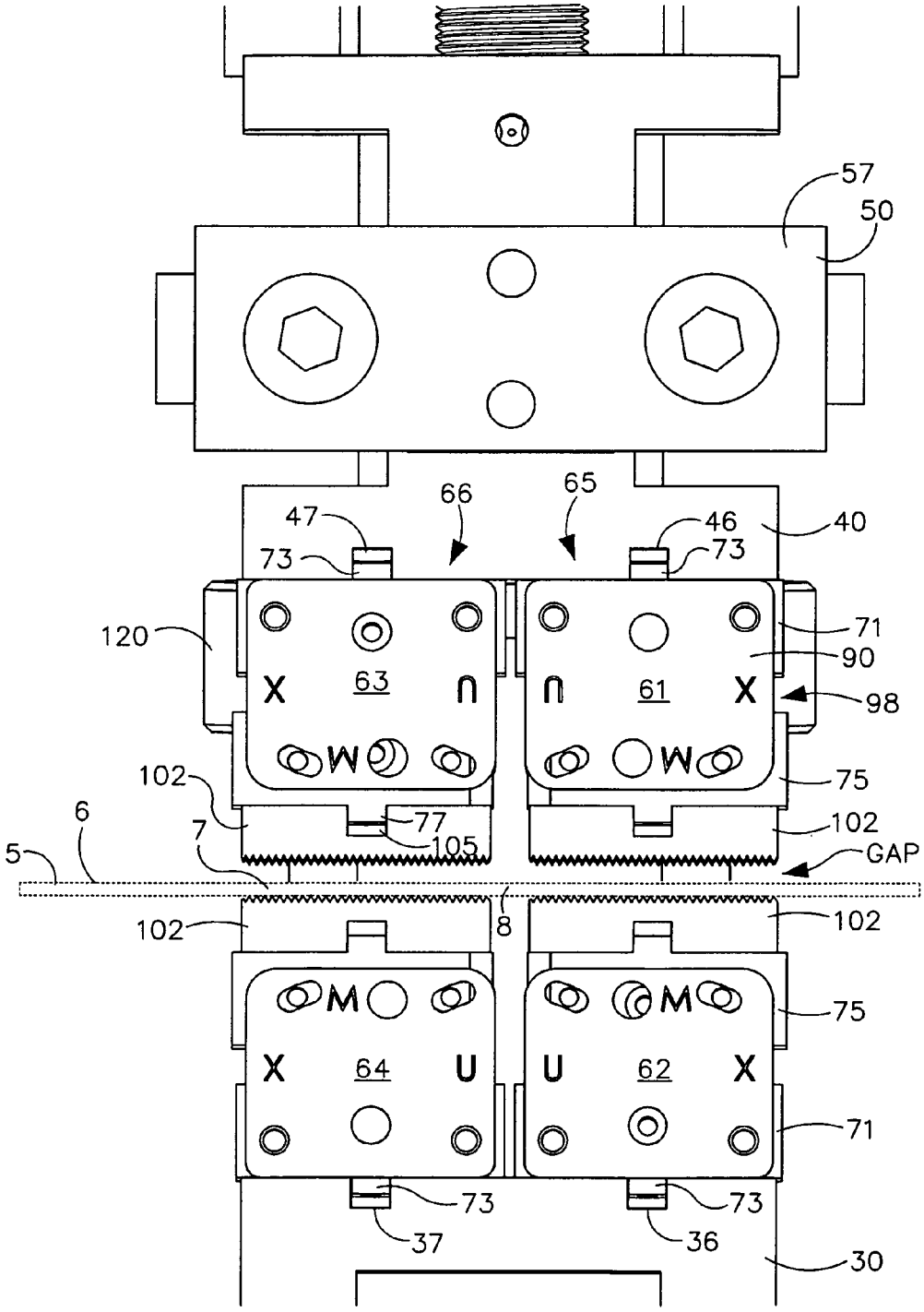
FIG. 8A is an enlarged front view showing a sheet metal workpiece 5 located in the Gap between tools 60 equipped with stretcher jaws 102 when ram 40 and piston rod 120 are in release positions 57 and 127.

When each cartridge 70 is assembled, the shape and orientation of the pockets 74 and 78, cams 80 and sleeve springs 85 bias the cartridge 70 and its block halves 71 and 75 into a home position 87 as in FIGS. 6A, 7A and 8A. In the home position 87, the cams 80 lean at about a 15° angle from normal to the surfaces 67 and 68 of the cartridge and the machine centerline 55. The sleeve springs 85 snuggly engage the cams 80. Although the cam 80 is shown as a cylinder, it should be understood that the cams could take a variety of shapes without departing from the broad aspects of the invention.

Figure 6B:
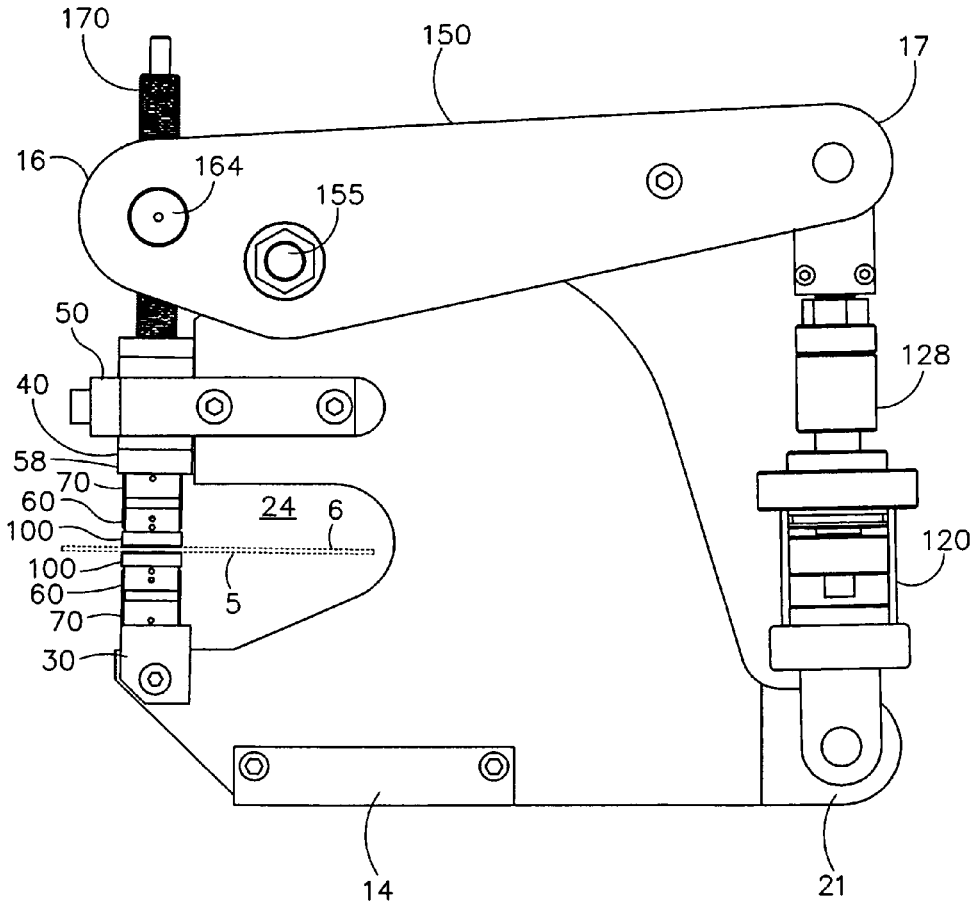
FIG. 6B is a side plan view showing a sheet metal workpiece 5 being initially gripped by the tools 60 when ram 40 and piston rod 120 are in gripping positions 58 and 128.
Figure 6C:
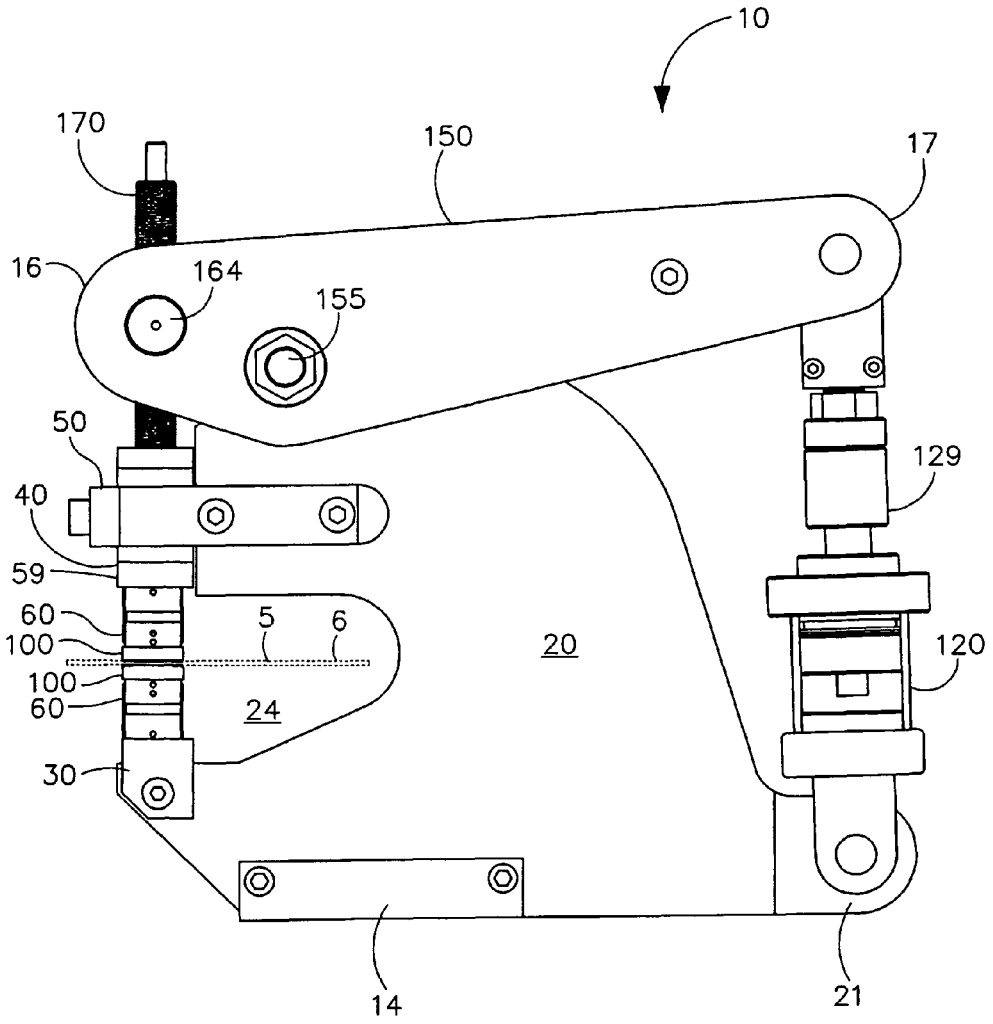
FIG. 6C is a side plan view showing a sheet metal workpiece 5 between tools 60 when ram 40 and piston rod 120 are in their fully extended positions 59 and 129.
Figure 7B:
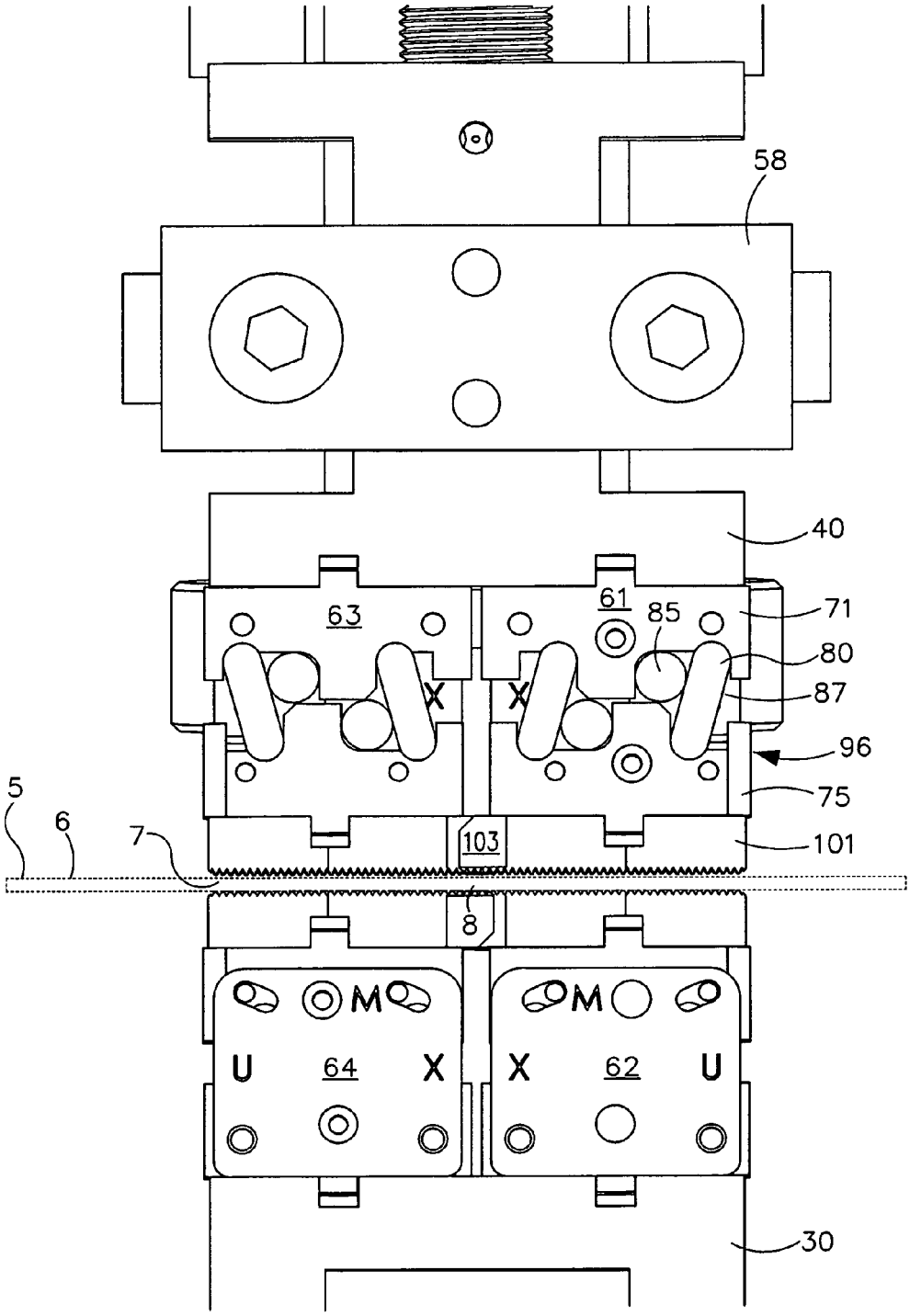
FIG. 7B is an enlarged front view showing a sheet metal workpiece 5 being initially gripped by tools 60 with shrinker jaws 101 when ram 40 and piston rod 120 are in gripping positions 58 and 128.
Figure 7C:
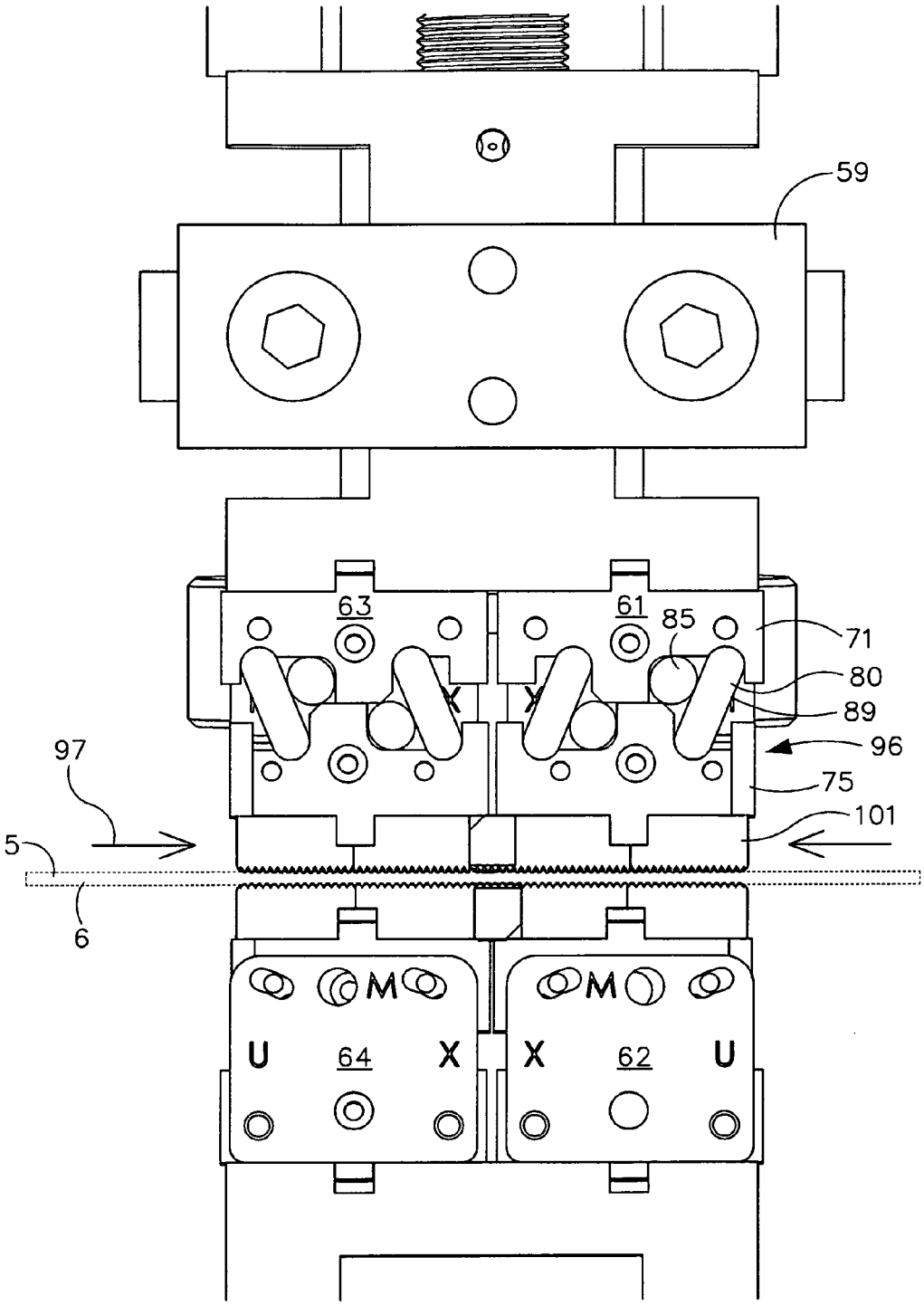
FIG. 7C is an enlarged front view showing a sheet metal workpiece 5 when ram 40 and piston rod 120 are in their fully extended positions 59 and 129, and when the cams 80 and moving blocks 75 of each cartridges 70 have moved toward the machine centerline 55 to shrink the area of the workpiece 5 between tools 60.
Figure 8B:
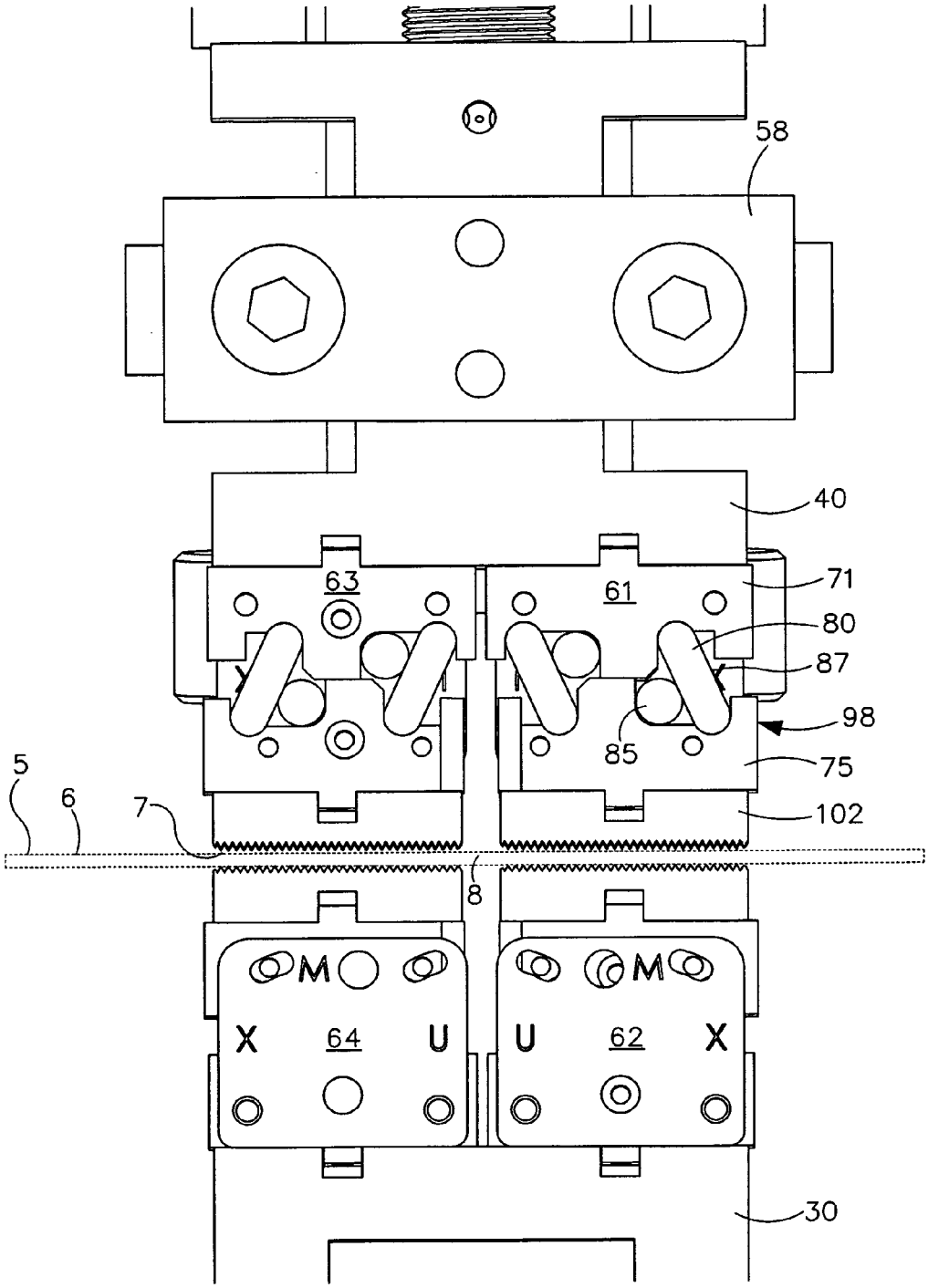
FIG. 8B is an enlarged front view showing a sheet metal workpiece 5 being initially gripped by tools 60 with stretcher jaws 102 when ram 40 and piston rod 120 are in gripping positions 58 and 128.
Figure 8C:
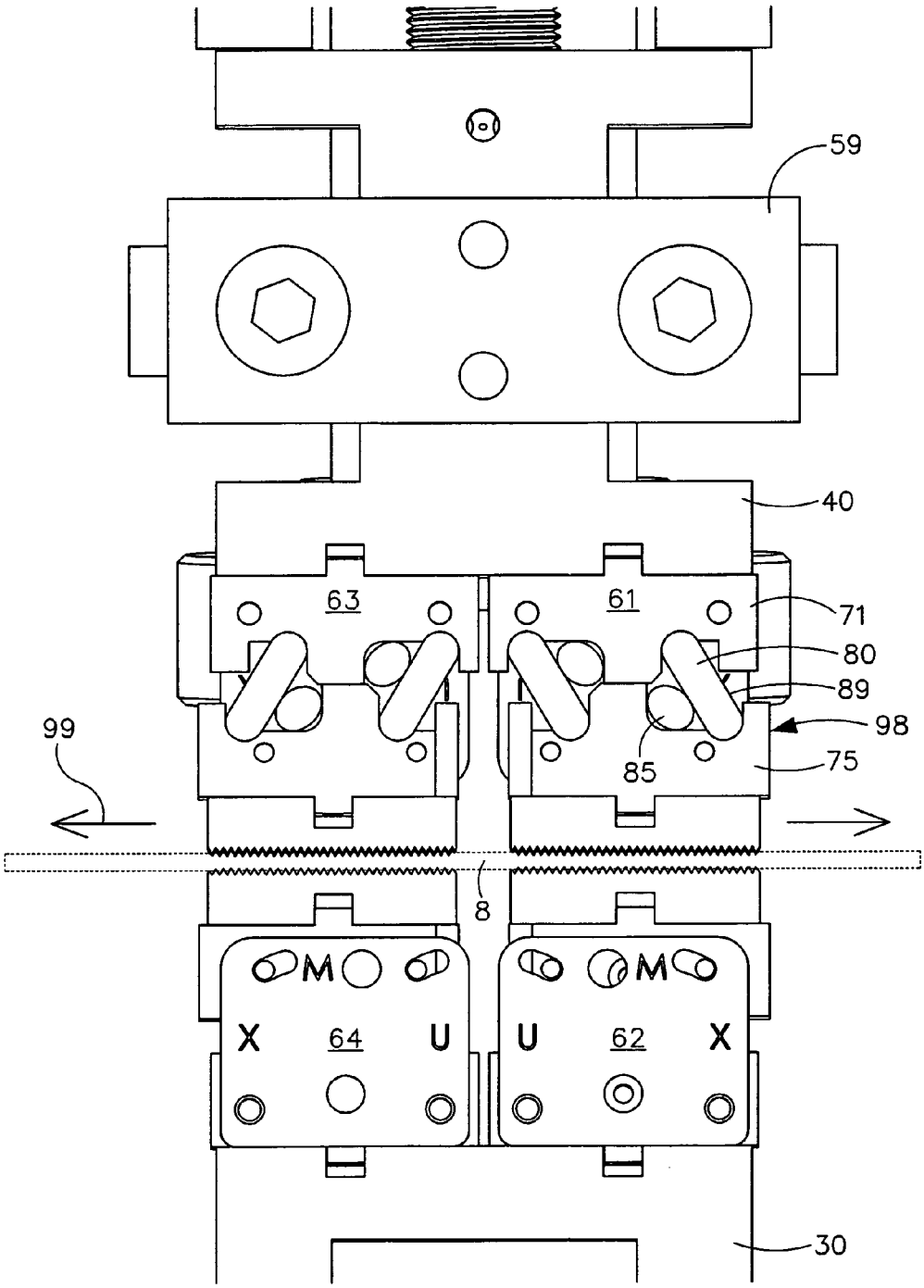
FIG. 8C is an enlarged front view showing a sheet metal workpiece 5 when ram 40 and piston rod 120 are in their fully extended positions 59 and 129, and when the cams 80 and moving blocks 75 of each cartridges 70 have moved away from the machine centerline 55 to stretch the area of the workpiece 5 between tools 60.

The cartridges 70 of the tools 60 can compress from home position 87 (FIGS. 6A-B, 7A-B and 8A-6B) to compressed position 89. (FIGS. 6C, 7C and 8C). This compression causes the cams 80 to rotate and moving block half 75 to shift laterally relative to its fixed block 71. The cams 80 rotate when they press into their adjacent polyurethane sleeves 85 with sufficient force to compress the sleeve. The hardness or resistance to compression of the sleeve 85 can be increased to achieve a higher gripping force between the tools 60 and the sheet metal 5 when in home position 87 (FIGS. 6B, 7B and 8B) before shrinking or stretching of the sheet metal 5 occurs as the tools compress to compressed position 89 as in FIGS. 6C, 7C and 8C. The shape of the pockets 74 and 78 and angle of the cams 80 when in the home position 87 can also be changed to adjust the amount of gripping force between the tools 60 and the sheet metal 5 before shrinking or stretching occurs.

Cover plates 90 are placed over and secured to the front and rear ends of each cartridge 70. The cover plates 90 are firmly secured to the fixed block halves 71, and movingly held by the moving block halves 75 via slots in the cover plate and a split pin inserted into holes in the block halves 75. The cover plates 90 help keep the cams 80 and sleeves 85 in place, help keep debris out of the interior of the cartridge 70, and help protect the operator during operation.

Each cover plate 90 is marked with the letters "M," "X" and "U" to designate in which of the four tool positions the tools 61-64 are to be placed on the machine 10. The "M" designates the side of the cartridge where the moving block half 75 is located. Each cartridge 70 is positioned with the "M" positioned toward the working area of the machine 10 where the sheet metal 5 is located between the tools 60 as shown in FIGS. 2, 7A-C and 8A-C. The "X" and "U" designates the direction in which the moving block half 75 will move during operation. The lateral movement of the moving block 75 occurs in the direction of the "X" and away from the "U." For shrinking, the tools 60 and cartridges 70 are inwardly oriented 96 with the "X" located toward the centerline 55 of machine 10 as in FIGS. 7A-C. When the tools 61-64 are in this shrinking orientation 96, each moving block 75 moves along a lateral path of travel 97 toward the machine centerline 55. For stretching, the tools 60 and cartridges 70 are outwardly oriented 98 with the "U" located toward the centerline 55 of machine 10 as in FIGS. 8A-C. When the tools 61-64 are in this stretching orientation 98, each moving block 75 moves along a lateral path of travel 99 away from the machine centerline 55.

Figure 4A:
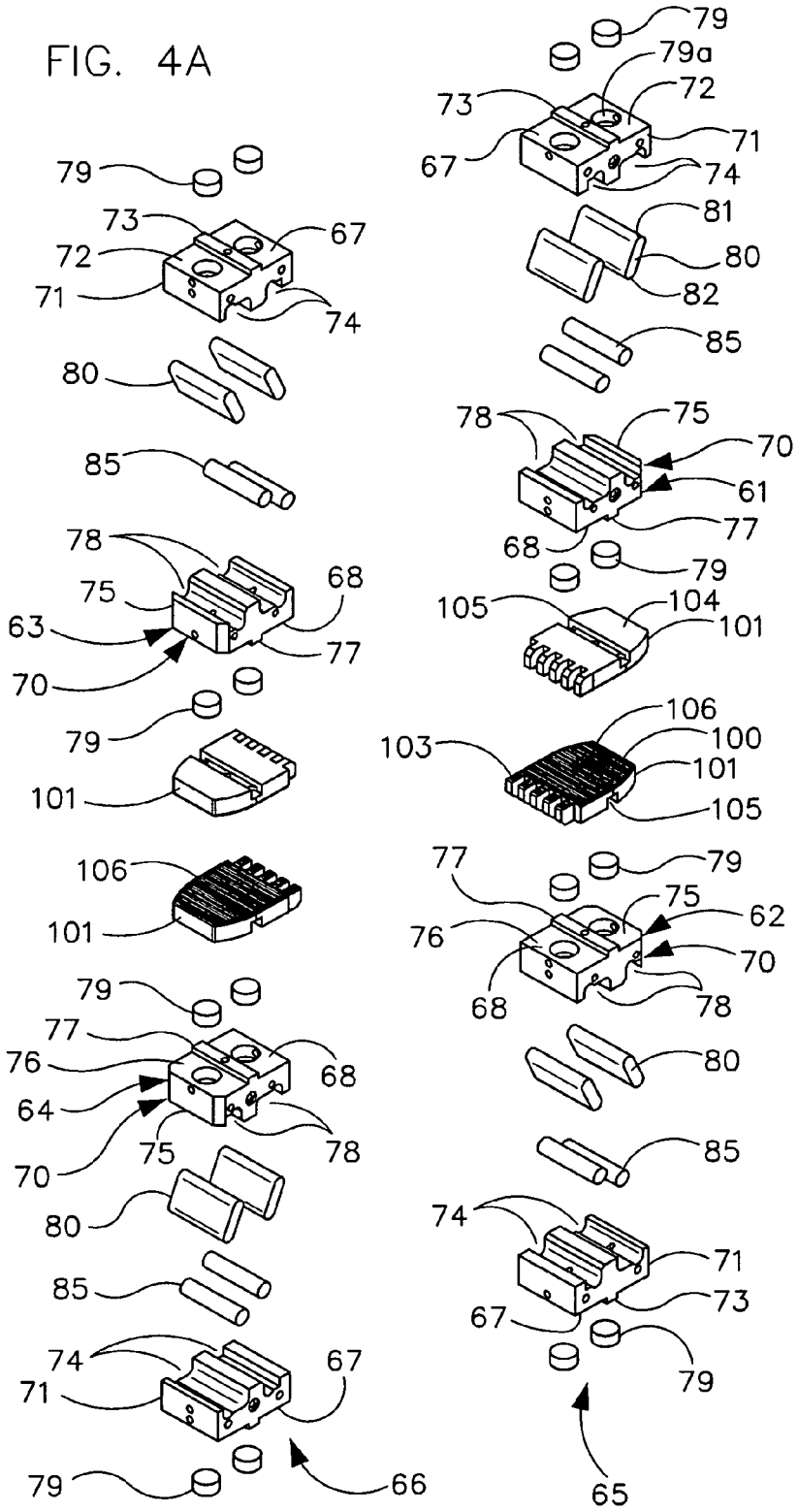
FIG. 4A is an exploded view of four tools 61-64 arranged in shrinking alignment.
Figure 4B:
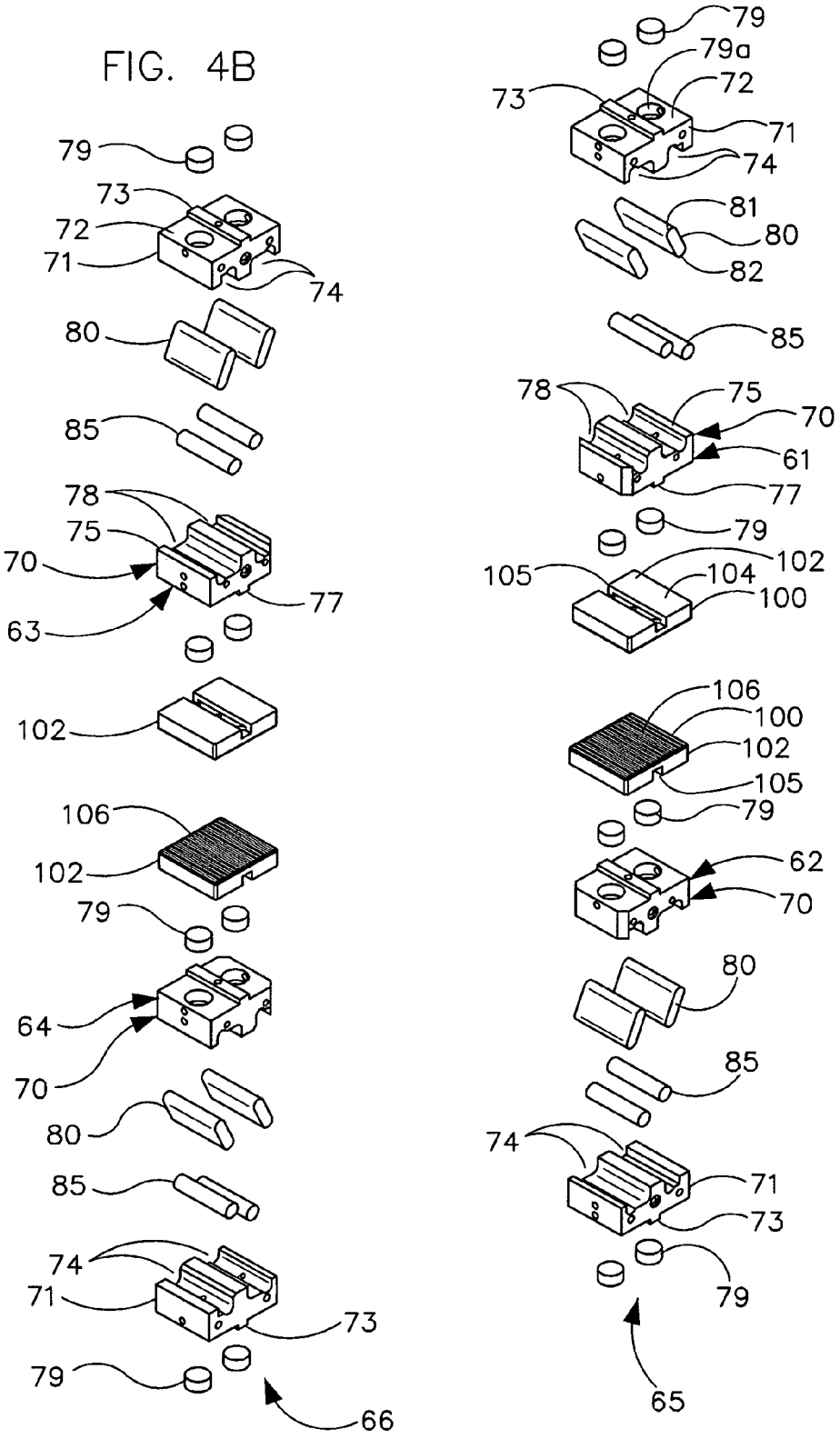
FIG. 4B is an exploded view of four tools 61-64 arranged in stretching alignment.

Each tool 60 has a gripping jaw 100 secured to its moving block 75. There are generally two types of gripping jaws 100. Shrinking jaws 101 are best shown in FIG. 4A. Stretching jaws 102 are best shown in FIG. 4B. Shrinking jaws 101 have opposed mating teeth 103 to prevent the sheet metal 5 from buckling when the sheet segment between the opposed jaws is compressed. Stretching jaws 102 do not have teeth as the sheet segment between the opposed jaws is being stretched. For a shrinking operation, each of the four tool cartridges 70 holds one shrinking jaw 101 as in FIGS. 7A-C. For a stretching operation, each of the four tool cartridges 70 holds one stretching jaw 102 as in FIGS. 8A-C.

Each cartridge 70 is structures to align and releasably secure or hold any one shrinking jaw 101 or any one stretching jaw 102 during the operation of the machine 10. Each jaw 101 and 102 has a flat lower surface 104 with a central slot 105 extending from the front to the back of the tool 60. The central slot 105 is keyed to the rib 77 of the moving block 75 of its cartridge 70, the components of which form a jaw alignment mechanism 108 to align the jaws of the matched sets of tool cartridges with each other and a predetermined distance from the machine centerline 55. While the magnets 79 in the moving blocks 75 hold their respective jaw 100 to the cartridge 70, the keyed engagement prevents side-to side movement of the jaw relative to the fixed block. While the holding power of the magnets 79 is sufficient to hold the jaws 100 to their respective cartridge 70 during operation, this holding power is readily overcome by the operator to remove the jaws when desired. While magnets 79 are shown holding the jaws 100 to the tool cartridges 70 for ease of securement and removal, it should be understood that the jaws could be secured with screws or other forms of securement without departing from the broad aspects of the invention.

Each shrinking 101 or stretching 102 jaw has a roughened outer surface 106 to bit into and grip the sheet metal 5. Different types of jaws 101 and 102 can be secured to the tools 60 to accommodate different types of sheet metal materials and thicknesses, or to obtain a desired sheet metal finish depending on whether the finished surface is to be extra smooth or extra rough.

Each anvil 30 and 40 is structured to align and releasably secure or hold two tool cartridges 70 during the operation of the machine 10. The fixed block 71 of each cartridge 70 is releasably secured to one of the anvils 30 and 40. The central rib 73 is keyed to one of the slots 36, 37, 46 or 47 to prevent side-to side movement of the fixed block 71, the components of which form first and second cartridge alignment mechanisms 109 to align the cartridges 70 to the fixed anvil 30 or drive ram 40, and to align the matched sets of cartridges 70 in registry with each other and a predetermined distance from the machine centerline 55. While the magnets 79 in the fixed blocks 71 hold the cartridge 70 to its respective anvil 30 or 40, the keyed engagement prevents side-to side movement of the fixed block 71 relative to the anvil. While the holding power of the magnets 79 is sufficient to hold the cartridge 70 to their respective anvil 30 or 40 during operation, this holding power is readily overcome by the operator to remove the cartridges when desired.

The ram or driven anvil 40 moves cyclically between a fully retracted position 57 and a fully extended position 59 as shown in FIGS. 6C, 7C and 8C. The distance between the upper surface 35 of the fixed anvil 30 and the lower surface 45 of the driven anvil 40 when the driven anvil is at its bottom-most or bottom dead center position 56 constitutes the "gap" between the workpiece forming tools 30 and 40. The linear movement 56 of the anvil 40 between its bottom dead center 59 and upper position 57 constitutes the stroke length SL of the anvil 41. As discussed more fully below, the size or height of the gap can be adjusted during the operation of the machine 10. While anvil 30 remains fixed during operation, the bottom dead center position 59 of anvil 40 can be adjusted up or down to increase or decrease the size of the gap. Adjusting the size or height of the gap does not impact the stroke length SL of the anvil 40. Adjusting the gap moves the entire stroke of the anvil 40. Both the top 57 and bottom 59 positions of the stroke move an equal amount when setting the gap.

The shrinker stretcher machine 10 includes a power supply and control system 110 for cyclically driving anvil 40 as shown in FIG. 1. The power supply and control system 110 includes a conventional hydraulic power unit 111, a conventional air compressor 115, a foot pedal 114 and a hydraulic cylinder 120. The hydraulic power unit 110 is secured to the base 12 of the frame 11. The hydraulic power unit 111 draws power via an electric cord plugged into a standard electric outlet. When activated by its on/off switch, the power unit 111 pressurizes the hydraulic fluid in its reservoir to up to 5,000 psi. An internal valve allows the pressurized fluid in the reservoir to selectively pressurize hydraulic fluid in a high pressure line 112. A foot pedal 114 is used to selectively open and close this internal valve, and thereby selectively pressurize fluid in line 112. The air compressor 115 drives the return stroke of the piston rod 125. The air compressor 115 pressurizes air in pneumatic line 117 in pneumatic communication with the air inlet port 124 of hydraulic cylinder 120. The air compressor 115 draws power via an electric cord plugged into a standard electric outlet.

The hydraulic cylinder 120 is secured to the rear of the upper support structure 20 of the machine 10. The lower portion or high pressure side of the cylinder housing 121 is pin 122 to the hinge 21 of the C-plate 20. The cylinder housing 121 has a hydraulic fluid port 123 and an air port 124. The hydraulic fluid port 123 is in fluid communication with high pressure hydraulic fluid line 112 and an interior fluid manifold inside its housing 121. An internal solenoid operating via the pressurized fluid in the manifold cyclically opens and closes an activation valve about once every two seconds to allow the hydraulic fluid in the manifold to pressurize a drive piston and piston rod 125. When the valve is open, the pressurized hydraulic fluid pushes and extends the piston and drive rod 125 from a retracted or home position 127 to an extended position 129. The piston has a bore diameter of about 2-12 inches, so the output or driving force of the piston rod 125 during its power stroke is about 10,000 pounds-force.

When activated by its on/off switch, the compressor 115 sends pressurizes air through air line 117 to the air inlet port 124 of the hydraulic cylinder 120, which is in pneumatic communication with the opposite side of the piston. When the activation valve of the hydraulic cylinder 120 is closed, the pressurized air pushes the piston and retracts its drive rod 125. As long as the hydraulic power unit 111 and air compressor 115 are turned on and the operator is depressing the foot pedal 114, the piston rod 125 will be cyclically extended and retracted about once every two seconds. Although the power supply system 110 is shown and described as a power system with a power unit 111 and hydraulic cylinder 120, it should be understood that other types of power supply systems could be used without departing from the broad aspects of the present shrinker stretcher machine invention.

The hydraulic power unit 111 and cylinder 120 power a ram drive assembly 130 best shown in FIGS. 1-3 and 6A. The ram drive assembly 130 is secured to the upper support structure 20 of the machine 10. The assembly 130 includes a piston rod coupling 141, reciprocating lever 150, drive coupling 160 and drive shaft 170. The couplings, pins, rods, lever and shaft components forming the drive assembly 130 are robustly designed to withstand the sufficient loads generated by the shrinker stretcher machine 10. The hydraulic cylinder 120, lever 150 and drive coupling are pivotally secured to the support plate 20. The piston rod 125, piston rod coupling 141 and drive coupling 141 are not directly secured to support plate 20. The ram or moving anvil 40 is movingly held between its guide 50 and the upper jaw 26 of the support plate 20.

The piston rod 125 extends upwardly from the hydraulic cylinder 120. The piston rod 125 has an adjustable stroke length of about ½ to 1 inch as best shown in FIGS. 6A-C. The stroke length of the piston rod 125 can be selectively varied (i.e., increased or decreased) via a stroke adjustment mechanism 126 located at the upper end of the cylinder 120. This is done by rotating threaded cap **126*a* as discussed below. As noted above, the lower end of the hydraulic cylinder is pinned 122 to the hinge 21 at the rear of the support plate 20. The upper end of the piston 125 is threadably secured to the lower end 142 of the piston coupling 141. The upper end 143 of the coupling 141 is pinned 144 to the reciprocating lever 150. The rod 125 remains substantially vertically oriented during the operation of the machine 10. The piston rod 125 extends or elevates the ram drive assembly 130 above machine opening 24 so that the ram 40 can move up and down relative to the working area 15 of the machine 10. This stroke of the piston rod 125 is sufficient to permit the ram 40 to be raised to its elevated or retracted position 57, and stroked linearly downward toward the fixed anvil 30 to its lower or bottom dead center position 59**.

The piston rod 125 returns its upper end and coupling 141 to the same upper most extended position 129 during each cycle of the hydraulic cylinder 120. The lever drive assembly 130 is made of rigid metal components that extend and retract the piston rod 125 and one end of the lever 150 in a rigid movement.

The reciprocating lever 150 is about 17 inches long and is located at the top of the machine 10 to accommodate and span the central opening 24. The lever 150 has opposed ends 151 and 152 and is formed by two uniformly spaced plates 153 that straddle C-plate 20. The rear end 151 is pivotally joined to the piston coupling 141 by pin 144. The front end 152 is pivotally joined to the drive coupling 161 by its pin shaped ends 162. The lever 150 reciprocally pivots about a pivot pin 155 that serves as a fulcrum for the lever. This fulcrum pin 155 is preferably located about 3.5 inches from the center of the front pivot point 164 and 14 inches from the center of the rear pivot point 144. The uniform spacing of the plates 153 is maintained by the piston coupling 141, a spacing collar 156 on the fulcrum pin 155 and a spacer 158 towards the rear of the lever 150.

The drive coupling 161 transitions the pivoting motion of reciprocating lever 150 into the linear motion of ram 40. During operation, the lever 150 remains substantially horizontal, but pivots about ½° to 2° in either direction. The drive coupling 161 is pivotally joined to the front ends of the lever plates 153 via its pin shaped ends 164. A central threaded hole 165 is provided for rigidly and adjustably joining the drive shaft 170 of the ram 40. The drive rod 170 is joined to the ram 40 via a greesed radiused pocket.

A gap adjustment assembly 180 is provided to set the "Gap" between the surface 35 and 45 of the anvil 30 and ram 40 when the ram is at its lower most position 59. The gap adjustment assembly 180 includes the threaded hole 165 of the drive coupling 161, the threadably joined drive rod 170, the ram 40 and a turn wheel 185. The wheel 185 is rotated to move the drive rod 170 and ram or moving anvil 40 between a maximum and minimum gap positions set by the upper and lower limit stops or flanges 41 and 43 of the ram 40. The gap adjustment assembly 180 allows for continuous adjustment of the Gap, so the Gap can be set to any of an infinite number of positions between lower 41 and upper 43 limit stops.

The stroke adjustment mechanism 126 is operated by turning threaded cap 126*a* to set the stroke of the stroke lengths "SL" of piston rod 125 and ram 40. Turning the cap 126*a* one way elongates cylinder 120 and increases the stroke length "SL" of the piston rod 125, which in turn sets the stroke length "SL" of ram 40. Turning the cap 126*a* the other way shortens the length of the cylinder 120 and decreases the stroke length "SL" of piston rod 125 and ram 40. As fulcrum 155 of lever 150 is four times closer to the front of the lever than the rear of the lever, an adjustment in the stroke length of piston rod 125 produces a one quarter adjustment in the stroke length of ram 40. The stroke length adjustment mechanism 126 allows for continuous adjustment of the stroke length SL of the ram 40 so the stroke length can be set to any of an infinite number of lengths between its maximum and minimum settings. The adjustment mechanism 126 selectively sets the full ram extension position 59, but has little or no effect on its retraction position 57.

Although the operation of the machine 10 should be readily understood based on the above description, the following is provided to assist the reader. The operator turns on the machine 10 by activating its power supply and control system 110. This is done by turning on the hydraulic power unit 111 and air compressor 115 shown in FIG. 1. Turning on the machine 10 does not automatically activate or pressurize the hydraulic cylinder 120, which requires the operator to depress the foot pedal 114, so the ram 40 and piston 125 remain in their retracted positions 57 and 127, respectively. To perform a shrinking operation, each tool 61-64 has its cartridge 70 positioned so that its cams 80 lean toward the centerline 55 of the machine 10 and is fitted with a shrinker jaw 101. (FIGS. 5A and 7A-C). The "X" marks on the cover plates 90 of the cartridges 70 are near the machine centerline 55. To perform a stretching operation, each tool 61-64 has its cartridge positioned (e.g., rotated 180°) so that its cams 80 lean away from the centerline 55 of the machine 10 and is fitted with a stretcher jaw 102. (FIGS. 5B and 8A-C). The "U" marks on the cover plates 90 of the cartridges 70 are near the machine centerline 55.

The sheet metal workpiece 5 is then placed in the Gap between the jaws 100 of the tools 60. The workpiece does not fill the entire Gap. The operator sets the desired Gap by turning the wheel 185 of the Gap adjustment assembly 180 to position the ram 40 and jaws 100 of the upper tools 61 and 63 at the desired retracted position 57 and 127 for the specific workpiece 5. Setting the Gap can be done before or after activating the machine 10, or even on the fly during the operation of the machine. Similarly, the operator can adjust the stroke length SL of the ram 40 and upper jaws 100 by turning the cap 126*a* of the cylinder 120 to set the fully extended positions 59 and 129 of the ram 40 and upper jaws 61 and 63, respectively. Setting the stroke length SL can be done before or after activating the machine 10. The area of the workpiece to be worked is positioned along the centerline 55 of the machine between the right set of tools 61 and 62 and the left set of tools 63 and 64.

The operator depresses foot pedal 114 to activate or pressurize hydraulic cylinder 120, and initiate the cycling of the piston rod 125 about once every two second. The cyclical movements of the ram 40, piston rod 125 and ram drive assembly 130 are the same each cycle for both shrinking and stretching operations. Each cycle of the machine 10 has a pressure stroke and a return stroke. The pressure stroke includes a first or gripping phase and a second or working phase. During the gripping portion or phase, the cylinder 120 and piston rod 125 longitudinally extend the ram 40 from retracted position 57 (FIGS. 6A, 7A and 8A) to position 58 where the jaws 100 engage and grip two portions 7 of the workpiece 5. (FIGS. 6B, 7B and 8B). During the working phase, the cylinder 120 and piston rod 125 further longitudinally extend the ram 40 from gripping position 58 (FIG. 7B or 8B) to position 59 where the jaws 100 have moved laterally 97 or 99 to shrink or stretch the ungripped portion 8 of the workpiece 5. (FIG. 7C or 8C).

Toward the end of the first or workpiece 5 gripping portion or phase of the pressure stroke, the tools 60 compress two gripped portions 7 of the workpiece 5 located on opposed sides of the machine centerline 55. The jaw 100 of each upper tool 61 or 63 compresses one of these gripped portions 7 against its respective jaw 100 of its lower tool 62 or 64. The jaw pressure produced by the cylinder 125, lever 150, angle of cams 80, and jaw surface areas 106, enables the jaws 100 to frictionally grip the surfaces 6 of the workpiece 5. Jaws 100 with roughened surfaces 106 can bite into the opposed surfaces 6 of the workpiece 5 to enhance this gripping action. The tools 60, jaws 100, cylinder 120 and lever 150 work in unison to generate a gripping force sufficiently strong to prevent the jaws from slipping on the workpiece 5 when the machine 10 begins to shrink or stretch the ungripped portion 8 of the sheet metal 5 between the jaws 100 of the right and left sets of tools 65 and 66 during the working portion of the pressure stroke.

During the workpiece 5 working portion of the pressure stroke, the tools 60 move the jaws 100 laterally to shrink or stretch the ungripped portion 8 of the workpiece 5 between the tools. During this portion of the pressure stroke, the force exerted by the cams 80 on the adjacent resilient compressible sleeves 85 reaches and exceeds a threshold level sufficient to actively compress the sleeves 85. The sleeves 85 uniformly compress due to the symmetry of the anvil 30, ram 40 and tools 60 about the machine centerline 55, as well as the geometry (e.g., flat and/or parallel surfaces) of these components and the sheet metal workpiece 5. The uniform compression of sleeves 85 causes the cams 80 to uniformly rotate in their tools 60. For a shrinking operation (FIGS. 7A-C), the cams 80 rotate toward the machine centerline 55. The cams 80 in tools 61 and 64 rotate clockwise, and the cams in the tools 62 and 63 rotate counterclockwise. This rotational movement of the cams 80 cause their moving blocks 75 and jaws 100 to move laterally while the fixed blocks 71 of the upper tools 61 and 63 continue move longitudinally with the ram 40 toward the fixed blocks 71 of the lower tools 62 and 63.

While the invention has been described with reference to a preferred embodiment, it will be understood by those skilled in the art that various changes may be made and equivalents may be substituted without departing from the broader aspects of the invention.

I claim:

1. A power shrinker stretcher apparatus for shaping a workpiece such as sheet metal, said power shrinker stretcher apparatus comprising:

a fixed anvil secured to a support structure, said fixed anvil and said support structure being adapted to receive the workpiece;

a drive ram cyclically movable along a path of travel toward and away from said fixed anvil between extended and retracted positions, said fixed anvil and path of travel of said ram being located on a centerline;

a drive assembly that cylindrically drives said ram between said extended and retracted positions during a cyclical power stroke of said drive ram, said power stroke having a workpiece gripping phase and a workpiece working phase;

a set of tool cartridges, each said tool cartridge having a jaw with a gripping surface, and a cam and a resilient member that bias the cartridge into a home position, each said tool cartridge being forcibly compressible via said drive ram into a compressed position with its said cam rotating into compressed engagement with its said resilient member, and said cartridges and jaws moving laterally relative to said centerline during said working phase;

each said tool cartridge being removably secured to one of either said drive ram and fixed anvil, said drive ram holding two spaced tool cartridges and said fixed anvil holding two spaced tool cartridges, each said tool cartridge and said jaw on said drive ram being in spaced registry with one said tool cartridge and said jaw on said fixed anvil to form first and second matched sets of tool cartridges and jaws, each of said tool cartridges being structured to operably secure to its said one of either said drive ram and fixed anvil when in a shrinking orientation and when in a stretching orientation; each of said tool cartridges being rotated 180° to change from its said shrinking orientation to its said stretching orientation; and, wherein said matched sets of tool cartridges and jaws move laterally toward said centerline to shrink the workpiece when in said shrinking orientation, and move laterally away from said centerline to stretch the workpiece when in said stretching orientation.

2. The power shrinker stretcher apparatus of claim 1, and wherein each said jaw of said tool cartridges on said driven ram moves toward one of said jaws on said tool cartridges of said fixed anvil during said gripping phase of said power stroke, each of said tool cartridges and said cams remaining in said home position until initiating gripping action upon said jaws of said matched sets of tool cartridges and jaws coming into a compressed gripping engagement with the workpiece to firmly grip opposed gripped portions of the workpiece between each of said matched sets of tool cartridges and jaws, and said matched sets of tool cartridges and jaws being spaced apart a predetermined distance from each other to provide an ungripped portion of the workpiece between said matched sets of tool cartridges and jaws.

3. The power shrinker stretcher apparatus of claim 1, and wherein said drive ram and each of its said tool cartridges are adapted to form a first cartridge alignment mechanism for aligning and fixedly securing its said tool cartridge a predetermined distance from said centerline, and wherein said fixed anvil and each of its said tool cartridges forms a second cartridge alignment mechanism for aligning and fixedly securing its said tool cartridge a predetermined distance from said centerline.

4. The power shrinker stretcher apparatus of claim 3, and wherein each of said alignment mechanisms is a keyed alignment mechanism formed by a slot and a mating rib.

5. The power shrinker stretcher apparatus of claim 3, and wherein each said tool cartridge has a designated position on one of either said drive ram and fixed anvil, and wherein each said tool cartridge is rotated 180° in its said designated position to change from said shrinking orientation to said stretching orientation.

6. The power shrinker stretcher apparatus of claim 5, and wherein each said tool cartridge is independently secured to and removed from its said designated position.

7. The power shrinker stretcher apparatus of claim 3, and wherein each said jaw is removably secured to its said tool cartridge, and each said jaw and its said tool cartridge are adapted to form a jaw alignment mechanism for aligning and fixedly securing said jaw to its said tool cartridge a predetermined distance from said centerline.

8. The power shrinker stretcher apparatus of claim 7, and wherein each of said jaw alignment mechanisms is a keyed alignment mechanism formed by a slot and a mating rib.

9. The power shrinker stretcher apparatus of claim 8, and wherein each said tool cartridge is removably secured to its said one of either said drive ram and fixed anvil by magnets, and each said jaw is removably secured to its said tool cartridge by magnets.

10. The power shrinker stretcher apparatus of claim 1, and wherein said drive assembly includes a hydraulic cylinder that cyclically extends and retracts a piston rod, said piston rod being in driving engagement with said drive ram via said drive assembly, said piston rod cyclically extending and retracting said drive ram.

11. The power shrinker stretcher apparatus of claim 10, and wherein said piston rod of said hydraulic cylinder has a stroke length, and further including a stroke length adjustment mechanism to increase and decrease the stroke length of said piston rod and said drive ram.

12. The power shrinker stretcher apparatus of claim 11, and wherein said stroke length adjustment mechanism includes a rotatable cap on said hydraulic cylinder.

13. The power shrinker stretcher apparatus of claim 10, and wherein said support structure includes a rigid C-shaped support plate forming a large central opening and mouth with upper and lower jaws adapted to receive the workpiece, said drive assembly being held by said C-shaped support plate and including a lever to extend around said central opening.

14. The power shrinker stretcher apparatus of claim 13, and further including a gap adjustment assembly connected to said lever, said gap adjustment assembly selectively moving said drive ram between a range of maximum and minimum gap positions to selectively set a gap between said fixed anvil and said drive ram.

15. The power shrinker stretcher apparatus of claim 14, and wherein said drive assembly includes a threaded drive rod connected to said drive ram, said drive rod being threadably connected to said lever via a threaded coupling, and wherein said gap adjustment mechanism includes a wheel for rotating said drive rod to extend and retract said drive rod and said drive ram.

16. The power shrinker stretcher apparatus of claim 15, and wherein said gap adjustment mechanism is operable while said drive assembly cyclically moves said jaws of its said drive ram against the workpiece during operation.

17. The power shrinker stretcher apparatus of claim 1, and wherein said resilient member is a resilient sleeve, said cam and resilient sleeve forming a cam and sleeve set, and said cam and sleeve set engage each other along their lengths.

18. The power shrinker stretcher apparatus of claim 17, and wherein each of said tool cartridges includes two cam and sleeve sets, each said cam being at about a 15° angle relative to said centerline when in said home position, and each said sleeve being made of polyurethane and having a hardness of about 90 durometers.

19. The power shrinker stretcher apparatus of claim 1, and further including a power supply and control system including a hydraulic power unit and a foot pedal to selectively supply pressurized hydraulic fluid to said hydraulic cylinder.

20. The power shrinker stretcher apparatus of claim 19, and wherein said power supply and control system includes an air compressor to return said piston rod to said retracted position each cycle.

* * * * *